US009227244B2

(12) United States Patent
Fais

(10) Patent No.: US 9,227,244 B2
(45) Date of Patent: Jan. 5, 2016

(54) SINTERING PROCESS AND CORRESPONDING SINTERING SYSTEM

(75) Inventor: Alessandro Fais, Turin (IT)

(73) Assignee: EPOS S.R.L., Turin (IT)

( * ) Notice: Subject to any disclaimer, the term of this patent is extended or adjusted under 35 U.S.C. 154(b) by 1234 days.

(21) Appl. No.: 13/140,940

(22) PCT Filed: Dec. 18, 2009

(86) PCT No.: PCT/IB2009/055857

§ 371 (c)(1),
(2), (4) Date: Sep. 8, 2011

(87) PCT Pub. No.: WO2010/070623

PCT Pub. Date: Jun. 24, 2010

(65) Prior Publication Data

US 2011/0316202 A1 Dec. 29, 2011

(30) Foreign Application Priority Data

Dec. 19, 2008 (EP) ..... 08425809

(51) Int. Cl.
*B22F 3/105* (2006.01)
*B22F 3/14* (2006.01)

(52) U.S. Cl.
CPC ..... *B22F 3/14* (2013.01); *B22F 2998/00* (2013.01); *B22F 2999/00* (2013.01)

(58) Field of Classification Search
USPC ..... 419/2, 48, 52
See application file for complete search history.

(56) References Cited

U.S. PATENT DOCUMENTS 2,355,954 A * 8/1944 Cremer ..... 419/52
3,241,956 A 3/1966 Kiyoshi (Continued)

FOREIGN PATENT DOCUMENTS

GB 1 481 006 7/1977

OTHER PUBLICATIONS

International Search Report for PCT/IB2009/055857, mailed Jun. 23, 2010.

*Primary Examiner* — George Wyszomierski
*Assistant Examiner* — Ngoclan T Mai
(74) *Attorney, Agent, or Firm* — Nixon & Vanderhye P.C.

(57) ABSTRACT

A process is described for the sintering of powders (D) comprising conductive powders, loose or in the form of powder compacts, that comprises the operations of: inserting said powders (D) in a mold (23; 33, 34); applying (5, 6) a pressure (P(t)) to said powders (D) in said mold (23; 33, 34) commanding (4) nominal pressure values to pressure application devices (5, 6) to said powders (D); applying (1, 2, 3, 4) one or more current impulses ($I_i$) to said powders (D) in said mold (23; 33, 34) for a respective time interval of predetermined duration ($t_f$), wherein said nominal pressure values (P(t)) commanded said pressure application devices (5, 6) defining an increment of pressure (P1) from a first pressure, value ($P_0$) to a second pressure value ($P_j$) greater | than said first pressure value ($P_0$) and said increment in the pressure (P4) being applied in a synchronized way with respect to the initiation of said time interval of predetermined duration ($t_f$) of the current impulse $(I_i)_o$.

10 Claims, 3 Drawing Sheets

(56) References Cited

U.S. PATENT DOCUMENTS 3,508,029 A * 4/1970 Inoue ..... 219/149
3,567,903 A * 3/1971 Parker ..... 219/149
5,989,487 A 11/1999 Yoo et al.
6,674,042 B1 * 1/2004 Walder et al. ..... 219/78.01

* cited by examiner

SINTERING PROCESS AND CORRESPONDING SINTERING SYSTEM

This application is the U.S. national phase of International Application No. PCT/IB2009/055857 filed 18 Dec. 2009 which designated the U.S. and claims priority to EP Patent Application No. 08425809.4 filed 19 Dec. 2008, the entire contents of each of which are hereby incorporated by reference.

The present invention relates to a sintering process for powders consisting of conductive powders, loose or in the form of powder compacts, comprising the operations of:

inserting said powders into a mould;

applying a pressure to said powders in said mould commanding nominal pressure values to pressure application devices to said powders;

applying one or more current impulses to said powders in said mould for a respective time interval of predetermined duration.

Sintering is the process through which powders are densified into a determined shape with specific mechanical, electromagnetic and thermal properties resulting from the shape, material microstructure and residual porosity thusly obtained.

Various processes are known which operate during sintering for obtaining the consolidation of powders, including plastic deformation, atomic diffusion activated through movement by thermal agitation of the atoms, i.e. from the temperature, obtained through thermal conduction or convection in sintering ovens, resistive or joule heating joule effect of the mould or powders, laser and microwaves assisted consolidation.

An industrial sintering process usually requires operation of:

pre-compacting of the powders appropriately blended with lubricants and binders (typically polymeric) into a blank with a shape that approximates that desired for the final product, through the use of a press;

transferring to an oven where the binders are eliminated and sintering occurs;

re-pressing and/or forging of the powders to obtain maximum density and adjust the shape of the component.

Sintering techniques present recurring drawbacks, such as a long processing time due to the time necessary to reach homogeneous temperatures in the green bodies and obtain sintering, or incomplete or partial densification due to an inefficient conduction or convection in the ovens. Non homogenous densification can occur also in green bodies that are poorly pre-compacted. A micro structural alteration can also occur due to the high temperatures and long time necessary to obtain full density.

The sintering process for electrically conductive materials can be carried out with the aid of electrical currents for the purpose of reducing processing time in a significant manner. When sintering is electrically assisted, the powders or green bodies must be positioned in appropriately designed moulds and therefore, rams are provided that function also as electrodes to convey the electrical current to the powders and to apply the mechanical pressure.

A system of this type is known from the U.S. Pat. No. 2,355,954. Similar systems are capable of densifying objects in tens of milliseconds through the application of single, double or triple impulses of low voltage-high current energy under conditions of constant pressure.

The document EP 0 671 232 describes a similar process, applied, however, only to the pre-compacting of powders without sintering, that envisions the application of a static pre-compacting pressure and then the use of a spring to follow the reduction in powder volume due to the current and to do this so that the system returns to the static pressure or the pre-compacting pressure. Therefore, at most such system produces a constant pressure during the current impulse.

The reduction in sintering time by electrical current has successively reached a limit of a few hundreds of microseconds per cycle with the adoption of direct discharge circuits that discharge the energy stored in a capacitor to a compacted powder under pressure. The direct discharge method also requires the use of high-voltage vacuum ion switches that are unreliable and must therefore be replaced frequently, not to mention that they are subject to localisation of the currents in the form of plasma due to the high voltages in the powders subjected to the process.

Processes are known that improve the quality of the compacted and sintered bodies and at the same time obtain a reduction in processing time through a procedure that envisions applying currents and exerting high pressure on the powders.

The document U.S. Pat. No. 3,241,956 describes a system in which a combination of continuous and alternate currents are applied to create conductive bridges between the conductive particles, and to heat the powders to increase plasticity through the high temperatures, increasing, during cooling successive to the application of current, the pressure in order to benefit from the higher level of temperature.

The document U.S. Pat. No. 3,567,903 describes a system that commands impulses of current. Preceding the impulse of current, the commanding of an impulse of pressure is envisioned, which, through the dynamics of the system, establishes a pressure rising edge that precedes the application of current. Such system operates determining low densities of energy per volume of powder that are not sufficient to obtain the full density. In addition, the pressure is applied through a unidirectional single-axis system that causes non-homogenous densification.

The present invention has for object to overcome the drawbacks of the prior art and obtain a sintering process solution allowing operation at high energy densities, obtaining greater densification and more homogeneity with respect to known processes and a greater process control.

According to the present invention, such object is achieved by means of a sintering process, as well as a corresponding sintering system having the characteristics set forth specifically in the annexed claims.

The invention will be described with reference to the annexed drawings, provided by way of non-limiting example only, in which.

Briefly, the proposed sintering process envisions to employ one or more electromagnetic energy impulses, in particular single, double or multiple impulses, provided through electrodes that operate also as moulds and/or as rams on the powders or powder compacts to be sintered. Such electromagnetic energy impulses are combined with synchronised pulses, i.e. increases, of mechanical pressure, with the goal of concentrating the applied energy into the inter-particle contacts. Each pulse of electromagnetic energy must be sufficiently intense to provide values of specific electromagnetic energy in the powders or powder compacts of at least 500 J/g measured in the working element as the integral of the product of the real part of the current and the voltage, calculated over the duration of the electromagnetic energy impulse. Continuous monitoring of the movement of the rams, the pressure, the voltage and the current during the process is envisioned to allow interruption of the electromagnetic energy supply circuit in case of uncontrolled fluctuations of the process parameters and to provide detailed information regarding the working component.

Figure 1:
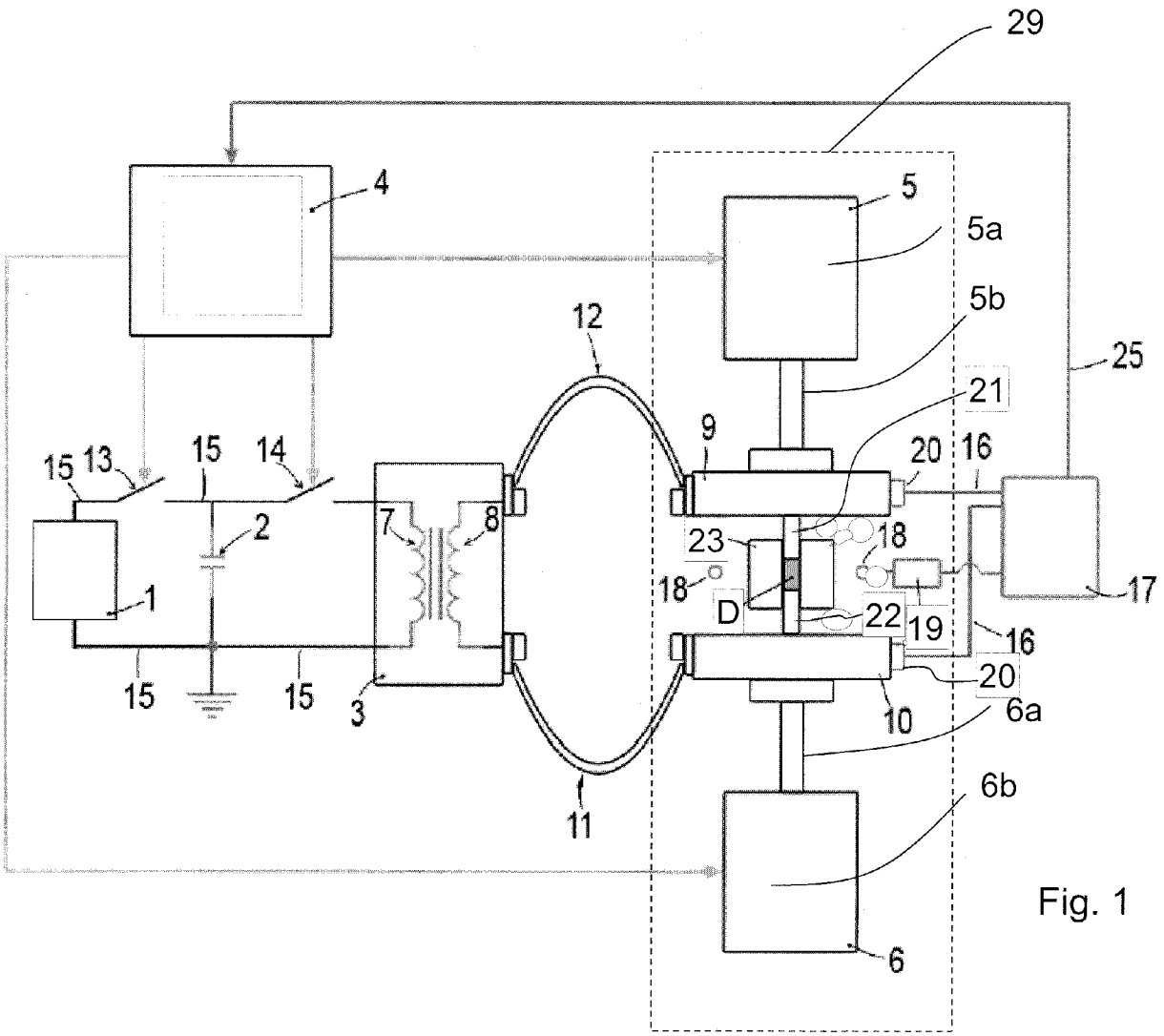
FIG. 1 represents a schematic diagram of an embodiment of a system actuating the sintering process according to the invention.

For such purpose, in FIG. 1 a schematic diagram is shown of a sintering system suitable for carrying out the sintering process according to the invention.

Such sintering system comprises an AC-DC converter indicated with the numerical reference 1, for example a rectifier, connected to a power source not shown in FIG. 1. A switch 13 separates the output of such converter 1 from a bank of capacitors arranged in parallel, while a second switch 14, connected downstream of such capacitor bank 2, separates it from the input terminals 7 of a transformer 3. Such switches 13 and 14 operate under the control of a process control unit 4, which commands their opening and closing states, allowing the bank of capacitors 2 to be charged to the desired charge levels, maintaining switch 13 closed and switch 14 in the open position. When the capacitor bank 2 reaches the desired voltage level, switch 13 is opened and switch 14 is closed, permitting the impulse of current determined by the charge in the capacitors 2 to reach the transformer 3. Output terminals 8 from the secondary of the transformer 3 are connected by means of cable conductors 11 and 12 to conductive plates 9 and 10 that are part of the pressing system 29. Such pressing system 29 comprises respective pressing devices 5 and 6 that operate under the control of the process control unit 4. Such pressing devices 5 and 6 can be, for example, screw presses, or oil hydraulic presses with membrane accumulators or an equivalent system able to apply a pressure according to the modes envisioned by the process according to the invention and described in greater detail in the following.

The pressing device 5 comprises, as mentioned, an actuator 5*a* that is connected by means of a stem 5*b* to a plate 9, which carries a ram 21 that is also conductive. Analogously, the pressing device 6 comprises a respective actuator 6*a*, connected by means of a respective stem 6*b* to a plate 20 and a respective conductive ram 22. A cylindrical mould with non-conductive side walls is indicated with numerical reference 23. The rams 21 and 22 operate in such mould 23 along the main axis of the cylinder identified by such mould 23 in opposite directions to compress the conductive powders D. The rams 21 and 22 are conductive, and thus function as electrodes in electrical continuity with the transformer 3.

The voltage signal is brought to an oscilloscope 17 through sampling electrodes 20 applied to each of the plates 9 or 10 and respective insulated cables 16. In addition, a Rogowsky coil 18 arranged around the mould 23 is also connected to the oscilloscope through a signal integrator 19 to monitor the electrical current in it. The oscilloscope 17 is connected by means of a communication line 25, for example a serial line, to the process control unit 4, which, in this way can monitor the movement of the rams, the pressure, the voltage and current in a continuous manner during the process, for the purpose, for example, of interrupting the electromagnetic energy supply circuit in case of uncontrolled fluctuations in process parameters and to provide detailed information regarding the working component.

Therefore, regarding the functioning of the sintering system described above, once the capacitor bank 2 is charged to the desired voltage, the switch 13 is opened, while the rams 21 and 22 are actuated to apply a first pressure $P_0$, by way of example such first pressure $P_0$ being comprised between 5 and 20 MPa, to assure good electrical contact with the powders D.

Through suitably synchronised activation signals, the process control unit 4 then sets the switch 14 to the closed position, releasing a current impulse $I_i$ and commands the actuation by the pressing devices 5 and 6 of increases of the pressure $P_i$ having a determined temporal trend. Such current impulses $I_i$ and pressure increases $P_i$ are described in more detail with reference to FIGS. 3 and 4, but, in general the increase in pressure $P_i$ is characterised by an increase in pressure from a first pressure $P_0$ to a second pressure $P_1$, said second pressure $P_1$ being for example variable in the range from 50-500 MPa. Therefore, the pressing devices 5 and 6 increase the pressure from the first pressure $P_0$ to the second pressure $P_1$ in a time interval included between a maximum time instant $t_m$ of the current impulse $I_i$ and a final time $t_f$ of the current impulse $I_i$.

In variant embodiments, pressure $P_0$ can be stabilized in time: the pressing devices 5 and 6 bring the powders to contact and increase the force, hence the pressure $P_0$, between them to a specified value which is kept constant for a few seconds. Once the signal is considered stable the increase to the second pressure $P_1$ is applied.

Figure 3:
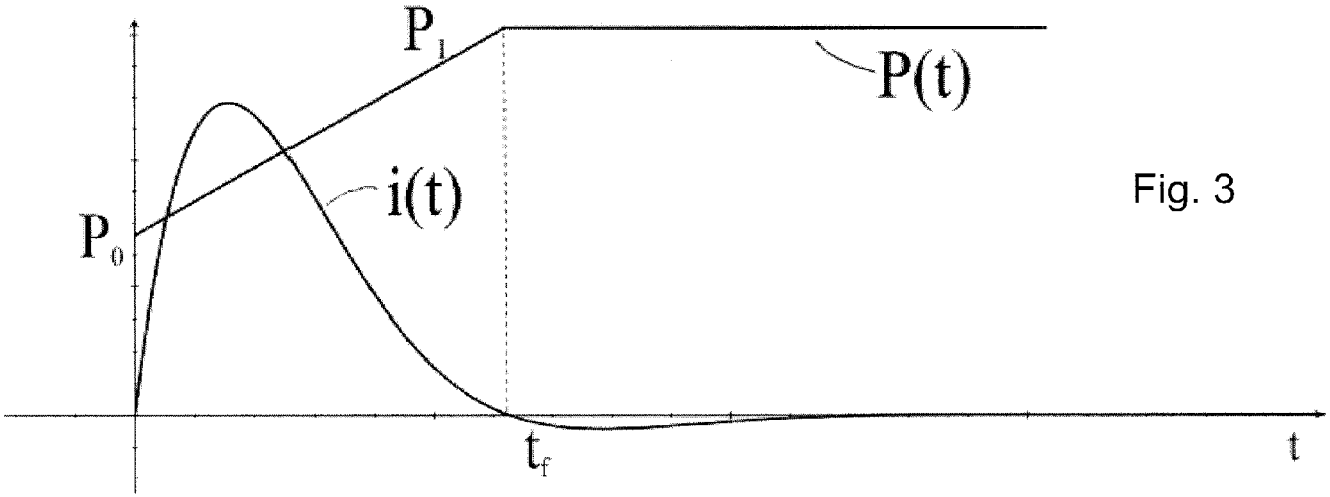
FIG. 3 represents an illustrative diagram of the currents and pressures according to a first operative mode of the sintering process according to the invention.
Figure 4:
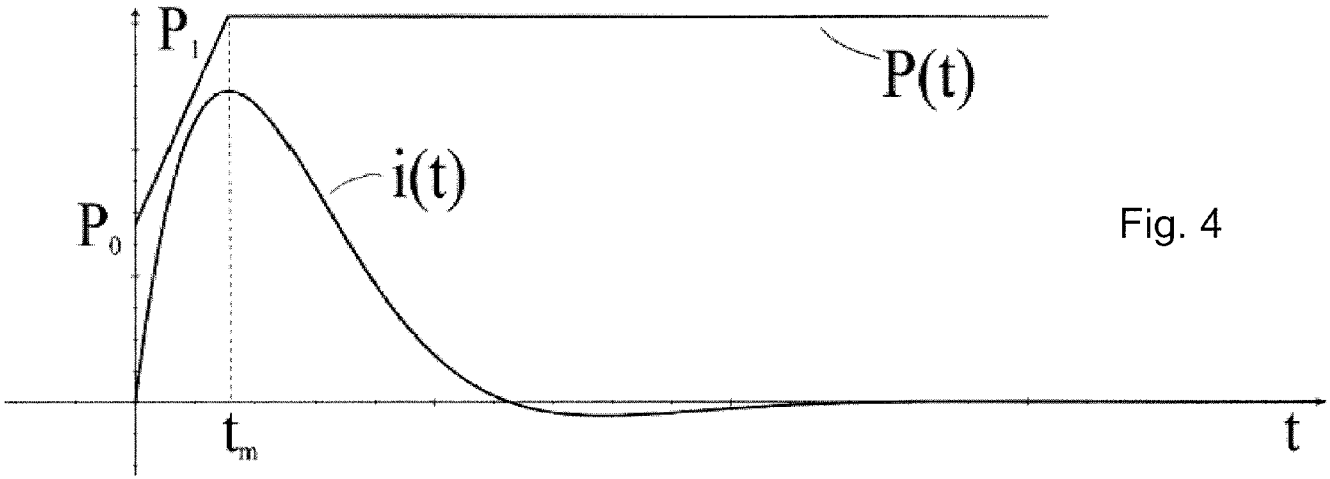
FIG. 4 represents an illustrative diagram of the currents and pressures according to a second operative mode of the sintering process according to the invention.

In FIGS. 3 and 4 a temporal diagram is shown in which the current in the powders is represented as a function of time i(t) showing the current impulse $I_i$, which initiates at time zero of the temporal diagram, reaches the maximum at $t_m$ and terminates the discharge of the capacitors at the end time $t_f$. In FIG. 3 a first operational mode is detailed in which the pressure as a function of time P(t) shows an increase in pressure, in particular a linear or monotonic increasing ramp, from a first pressure $P_0$ to a second pressure $P_1$, such increase commencing in correspondence to time instant zero and ending in correspondence to the finish time instant $t_f$. In other words, the process envisages the application of one or more current impulses for a respective time interval of predetermined duration, which corresponds to the duration between time instant zero at the beginning and the finish time instant $t_f$, to apply the pressure exerting an increase $P_i$ of its value from a first pressure value $P_0$ to a second pressure value $P_1$, the pressure increase $P_i$ being applied in the time interval of predetermined duration of the current impulse $I_i$ in a synchronised manner with respect to its initiation time instant, i.e. the pressure increase $P_i$ initiates in the same instant that the current impulse $I_i$ initiates, and in a distributed way in such time interval of predetermined duration.

The pressure P(t), after having reached the second pressure $P_1$, can be maintained constant for a certain time or diminish.

The pressure trends during application of the current impulse shown in FIGS. 3 and 4 take into consideration the evolution and form of the porosity in the powders during the discharge of current. In fact, during the current impulse the sizes of the porosities in the powders are reduced and the geometries smoothed and rounded leading to shorter notch roots. In order for the local tensional state of compression of the peaks of the porosity to remain unaltered or grow during the densification, increasing nominal macroscopic pressure values are used during the current impulse. The variations in pressure can increase uniformly or discontinuously or in any case increase so that the final value, that is, the second pressure value $P_1$, greater that the initial one, the first pressure value $P_0$, is reached during the current impulse, and coincides with the maximum time $t_m$ of the current impulse $I_i$ or with the final time $t_f$ of the impulse or it occurs in a position intermediate between the two times $t_m$ and $t_f$.

Without being tied to a specific theory to this regard, what have been previously described can be regarded as a manifestation of a superimposition of pressure and current, which benefits from the high deformability due to the electroplastic effect. The electro-plastic effect is the diminution of yield strength and increase of strain rate of the material when, together with the mechanical strain is superimposed a variation of electrical current.

Through the choice of the pressure values and the modulation of the pressure variation during the double-effect action of the two independently controlled rams, it is possible to localise and concentrate the specific energy in well determined regions of the desired shape. The local increases in specific energy obtained in this way allow control of the local physical properties of the object produced, favouring both the controlled localisation of porosities and local variations of the microstructural characteristics which can be designed. By way of example, one ram can be controlled to execute a first pressure ramp with a first slope and the other ram can be controlled to execute a second pressure ramp, in the same arc of time, but with a second slope different from the first, i.e. reaching a greater or lesser final pressure. In this way a porosity gradient is obtained in the produced object. The entire process can be carried out in a controlled manner, performing feedback control of the rams commanded by the values of voltage and/or current and/or energy and/or electrical resistance and/or sinking depth that can be monitored with the oscilloscope and/or other possible measurable physical quantities.

In such context, multiple impulses can be used as multiple steps in a classical powder forging. In components with different sections for example, a different value of specific energy can be associated with each compression step, that by acting on locally different structures and geometries will be distributed in a controlled manner to facilitate the movement of material and sintering.

Therefore, the voltage accumulated in the capacitor bank 2 is discharged through the step-down type transformer 3 onto a chain of resistive elements arranged downstream of the secondary of said transformer 3, which comprises the electrically conductive elements 8, 9, 10, 11, 12, 21, 22.

To maximise the current flow in powders D, the mould 23 can be constituted of, or coated internally with, dielectric material with conductivity lower than that of the loose powder or that of the powder compact.

Figure 2:
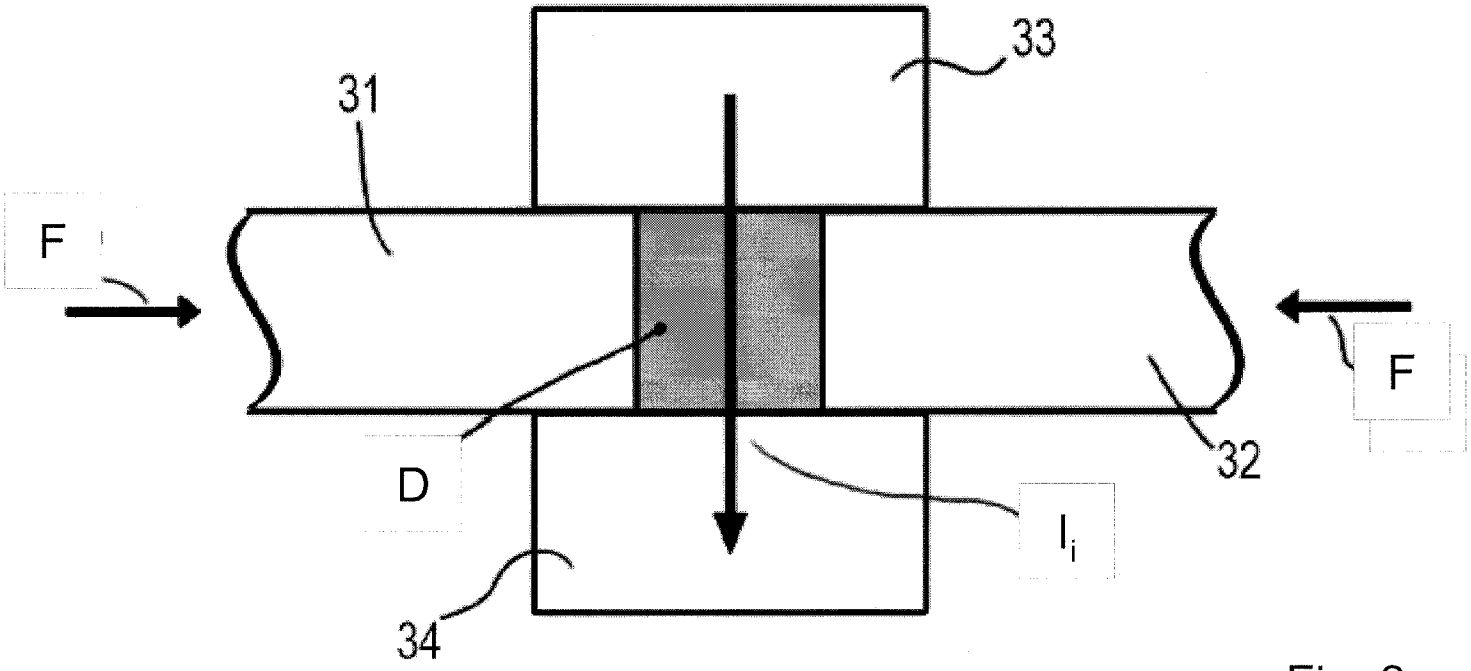
FIG. 2 represents a schematic diagram of a further embodiment of a system actuating the sintering process according to the invention.

FIG. 2 shows a detail of an alternative embodiment of the sintering system of FIG. 1. In such embodiment, it is envisioned to replace the dielectric mould 23 with a mould that forms a parallelepiped shaped cavity arranged horizontally in figure, having two conductive elements 33 and 34, respectively upper and lower, through which the current flows into the powders D. Such conductive elements 33 and 34 are connected to cables 11 and 12 in FIG. 1, while the pressure is applied to the powders D by means of non-conductive rams 31 and 32, which in FIG. 2 operate axially with respect to the cavity of the mould and in a horizontal direction, exerting a force F. The forces operating on the two rams 31 and 32, in this embodiment as in the previous, are not necessarily identical, for example when a non-homogenous densification or a porosity gradient is required in the sintered body. The process can be completely executed in air.

The specific energy s.e. applied to the powders D can be evaluated by multiplying a voltage drop v(t) by a current i(t) on the powders D, such product being then integrated over the duration of the current impulse $I_i$, corresponding to the finish time $t_f$, and normalised with respect to a mass m of the conductive powders, according to the relation:

$$s.e. = \frac{1}{m} \cdot \int_0^{t_f} v(t) \cdot i(t) dt$$

Such evaluation can be carried out by the process control unit 4.

In general, the sintering process according to the invention envisions the application of voltage drops v(t) with magnitudes between 30V and 3000V.

Several examples of parameters applicable to the sintering process according to the invention are provided herein.

EXAMPLE 1

2 g of 99% pure iron powder without binders are inserted in a cylindrical dielectric mould with conductive rams having a diameter of 10 mm. A first pressure $P_0$ of 10 MPa is applied, then a 5.5 kJ electromagnetic energy pulse with a finish time $t_f$=20 ms is applied. A synchronised impulse or increase in pressure from the first pressure $P_0$ to a second pressure $P_1$ of 250 MPa is applied. Sintered disks with theoretical densities of 96% are obtained.

EXAMPLE 2

2 g of ground copper powder with mean crystallite dimensions of 25 nm are inserted in a cylindrical dielectric mould with conductive rams having a diameter of 5 mm. The first pressure $P_0$ is 50 MPa, the electromagnetic energy impulse has a duration $t_f$=30 ms and electromagnetic energy of 6 kJ. The second pressure $P_1$, reached during the impulse $I_i$ is of 350 MPa. This allows a sintered disk to be obtained with 94% of the theoretic density, having mean crystallite dimensions of 26 nm and Vickers micro hardness (300 gf) of 183 HV.

EXAMPLE 3

6 g of tungsten carbide alloyed with cobalt (88% WC and 12% Co) with a mean tungsten carbide particle dimension of 120 nm are inserted into a cylindrical dielectric mould with conductive rams of 5 mm diameter. The first pressure $P_0$ of 50 MPa, the 30 kJ electromagnetic energy or current impulse has a duration $t_f$=15 ms and electromagnetic energy of 30 kJ. The increase in pressure $P_i$ synchronised with the current impulse $I_i$ is such to reach a second pressure $P_1$ of 250 MPa. This allows a sintered disk to be obtained with 99% of the theoretical density and a mean tungsten carbide particle dimension of 120 nm. As was said, in the sintering process according to the invention, the specific energy is preferably greater than 0.5 kJ/g.

EXAMPLE 4

2 g of 99% pure iron without binders are inserted in a cylindrical dielectric mould with conductive rams having a diameter of 10 mm. A first pressure $P_0$ of 50 MPa is applied, the electromagnetic energy impulse which has a final time $t_f$=30 ms and energy of 2.1 kJ is applied. A synchronised impulse or increase in pressure from the first pressure $P_0$ to a second pressure $P_1$ of 130 MPa is applied. Sintered disks with theoretical densities of 99% are obtained. For a comparison, if a pressure of 250 MPa (approximately the double of pressure $P_1$) is maintained constant (i.e. without variation of the pressure) during the process, the energy of 2.1 kJ allows obtaining a relative density of 87%. It is found that if the current discharge takes place before the pressure variation the material is only heat compacted, not sintered.

EXAMPLE 5

2 g of ground copper powder with mean crystallite dimensions of 25 nm are inserted in a cylindrical dielectric mould with conductive rams having a diameter of 10 mm. The first pressure $P_0$ is 50 MPa, the electromagnetic energy impulse has a duration $t_f$=30 ms and electromagnetic energy of 6 kJ. The second pressure $P_1$, reached during the impulse $I_i$ is 350 MPa. This allows a sintered disk to be obtained with 100% of the theoretic density, having mean crystallite dimensions of 26 nm and Vickers micro hardness (300 gf) of 183 HV Thus, according to further embodiments, the first pressure $P_0$ can be chosen between 5 and 50 MPa.

EXAMPLE 6

6 g of tungsten carbide alloyed with cobalt (88% WC and 12% Co) with a mean tungsten carbide particle dimension of 120 nm are inserted into a cylindrical dielectric mould with conductive rams of 10 mm diameter. The first pressure $P_0$ of 200 MPa, the electromagnetic energy or current impulse has a duration $t_f$=30 ms and electromagnetic energy of 30 kJ.

The pressure increase $P_i$ synchronised with the current impulse $I_i$ is such to reach a second pressure $P_1$ of 300 MPa. This allows a sintered disk to be obtained with 99% of the theoretical density and a mean tungsten carbide particle dimension of 120 nm.

Thus, according to further embodiments, the first pressure $P_0$ can be chosen between 5 and 200 MPa.

Therefore, the advantages of the process and system according to the invention are clear from the description presented above.

The proposed sintering process and system allow porous, partially porous or full density sintered objects to be obtained with variations of the process parameters and of the mould and/or ram geometries used. In addition, full density sintered objects are obtained with little or no inter-atomic diffusion, therefore, during the process little or no increase in particle size is caused, leaving in this way essentially unaltered the microstructure of the powders used. In this way mechanical properties such as resistance to stress and hardness are enhanced.

Through incrementing of the applied pressure in a manner synchronised with the current impulse, the proposed sintering process allows optimisation of the available energy on the surface of the powder particles and avoids unnecessary dissipation. Without being tied to a specific theory to this regard, it is believed that this identifies a plastic deformation of the conducting powders in the context of the electro-plastic effect, presumably also in presence of a high degree of disorder and strain hardening, as described with a grain size lower than the limit of 100 nm, this later aspect being held ascribable to the combination of high currents, made homogenous in the powder compact, and short process times, useful to partially or totally inhibit the growth of the grains.

The adoption of high voltages, between 30V to 3000V, advantageously allows the densification of longer objects with respect to known systems, for example, iron cylinders that are 20-30 mm in length and 5-10 mm in width.

The proposed sintering process envisions a flexible process for obtaining sintered bodies with full density or with a porosity density gradient, in particular for applications that require porous or partially porous bodies, such as for example bearings.

In addition, the proposed sintering process allows the forming and forging of the powders during sintering, increasing their density and shaping them in an appropriately designed mould when needed.

Naturally, without prejudice to the underlying principles of the invention, the details and embodiments may vary, even appreciable, with reference to what has been described and illustrated by way of example only without departing from the scope of the present invention.

The sintering process according to the invention, as was said, envisions increases of pressure during the process. This implies maintaining and increasing the pressure exerted on the powders during the current impulse. For this purpose the use of fast presses is preferred, such as mechanical screw presses or also high speed electrically driven screw presses or oleo hydraulic presses in which the pistons are integrated with membrane accumulators in order to obtain an impulse of mechanical force contemporaneously with the discharge. The pressure values provided in the examples are indicative and could vary from material to material according to experimental evidence.

The powders to be sintered, loose or compacted, can be a mixture of conductive and non-conductive powders.

It is also clear that the mould used could have forms different from the cylindrical form illustrated as an example, according to the needs of the body to be sintered.

In the case of materials requiring multiple impulses it could be necessary to apply the first impulses without variation of the pressure, to heat the powders, and the sintering impulse with variation of the pressure or to have different variations in pressure from one current impulse to another, for example from 50 to 250 MPa in the first, from 100 to 250 MPa or 350 MPa in the second and so on.

The invention claimed is:

1. A sintering process for powders comprising electrically conductive powders, loose or in the form of powder compacts, that comprises the operations of:

inserting said powders in a mould;

applying a pressure (P(t)) to said powders in said mould commanding nominal pressure values to pressure application devices to said powders;

applying one or more current impulses ($I_1$) to said powders in said mould for a respective time interval of predetermined duration ($t_f$), wherein said pressure (P(t)) is applied to said powders through said pressure application devices in at least two opposing directions, said nominal pressure values (P(t)) are commanded to said pressure application devices defining a pressure increment ($P_1$) from a first pressure value ($P_0$) to a second pressure value (Pi) greater than said first pressure value (Po), said pressure increment ($P_1$) being applied in a synchronised manner with respect to the initiation of said time interval of predetermined duration ($t_f$) of the current impulse ($I_1$), said increment of pressure ($P_1$) being also distributed in said time interval of predetermined duration ($t_f$) of the current impulse ($I_1$) so to reach said second pressure value (Pi) in an instant in time included between the time instant ($t_m$) at which said current impulse ($I_1$) reaches its maximum value and an end instant of said time interval of predetermined duration ($t_f$).

2. The process according to claim 1, wherein said operation of exerting an increment of the pressure ($P_1$) comprises reaching said second pressure (Pi) in correspondence with the end of said time interval of predetermined duration ($t_f$).

3. The process according to claim 1, wherein said operation of exerting an increment of the pressure ($P_1$) comprises reaching said second pressure (Pi) in correspondence with the time instant ($t_m$) at which said current impulse ($I_1$) reaches the maximum value.

4. The process according to claim 1, wherein said mould comprises non-conductive side walls and said pressure is applied, in particular axially, through conductive rams.

5. The process according to claim 1, wherein said mould comprises conductive portions and said pressure (P(t)) is applied to said powders through non-conductive rams.

6. The process according to claim 1, wherein it comprises applying a voltage (v(t)) of greater than 30V to said powders.

7. The process according to claim 1, wherein it comprises operating with specific energies greater than 500 J/g.

8. The process according to claim 1, wherein it comprises monitoring one or more parameters between the movement of the rams, the pressure (P(t)), a voltage (v(t)) and a current (i(t)) in a continuous way to interrupt the supply of electromagnetic energy in case of uncontrolled fluctuations of the process parameters and/or to provide detailed information concerning a working component.

9. The process according to claim 1, wherein said increment of pressure ($P_1$) comprises a linear or monotonic increasing ramp from the first pressure ($P_0$) to the second pressure (Pi).

10. The process according to claim 1, wherein it comprises modulating said increment of pressure ($P_1$) to control porosity, in particular to obtain porosity gradients.

* * * * *